United States Patent [19]

Silverthorn

[11] 4,453,544

[45] Jun. 12, 1984

[54] UNIVERSAL CANISTER MOUNT

[75] Inventor: Gideon C. Silverthorn, Kanata, Canada

[73] Assignee: Her Majesty the Queen in right of Canada, as represented by the Minister of National Defence, Ontario, Canada

[21] Appl. No.: 379,497

[22] Filed: May 18, 1982

[30] Foreign Application Priority Data

Jun. 25, 1981 [CA] Canada ..... 380596

[51] Int. Cl.[3] ..... A62B 9/04

[52] U.S. Cl. ..... 128/206.17; 128/206.15; 55/DIG. 33; 55/DIG. 35

[58] Field of Search ..... 128/206.16, 206.17, 128/205.29, 206.15, 201.25, 202.27, 205.27; 55/DIG. 33, DIG. 35; 137/454.2, 454.5, 454.6, 234.5, 376; 285/331, 201, 202, 203, 204, DIG. 22

[56] References Cited

FOREIGN PATENT DOCUMENTS 142941 7/1980 German Democratic Rep. ..... 128/206.17

102415 8/1963 Norway ..... 128/206.17

*Primary Examiner*—Henry J. Recla

*Assistant Examiner*—Karin M. Reichle

*Attorney, Agent, or Firm*—Cushman, Darby & Cushman

[57] ABSTRACT

A multiple canister mount for receiving at different times different sized bolt connectors of canisters for protective masks and the like. The device comprises a base and a pair of spaced annular rims secured to and upwardly projecting from the base. The inner wall of each rim is threaded with threads of appropriate form, and is of a diameter, so as to receive a canister bolt connector of particular size and having a particular thread form. The device also comprises a centrally disposed valve opening and valve seat secured to the base. Such a device provides a simple effective means for securing canisters, which may have different sized bolt connectors, at different times to the same protective mask.

6 Claims, 3 Drawing Figures

UNIVERSAL CANISTER MOUNT

BACKGROUND OF THE INVENTION

The present invention relates to a multiple canister mount, and more particularly to a canister mount for a protective mask or the like which will consecutively receive canisters having bolt connectors of differing size and/or differing thread form.

A protective mask which is currently used extensively by military and civilian organizations has a flexible face covering which is strapped in an airtight fashion to the face of the wearer. Components of the mask secured to the flexible face covering include transparent viewing means, an outlet valve and speech unit and removable canister filled with charcoal or a similar absorbant substance releasably secured in airtight fashion to an appropriate mount means secured to the mask, through which canister during operation outside air is purified as it is drawn through appropriate valve means into the interior of the mask.

At the present time different countries manufacture different types of such masks and respirators and there are consequently different sizes of canister connectors and canister mount means therefor.

Attempts have been made to standardize these canister connectors and canister mounts. For example, NATO countries have recently agreed to a standardization program for canisters and protective masks and respirators aimed at creating a single size of canister bolt connector having a standard thread form, which would be received in a correspondingly sized and threaded canister mount in the protective mask or respirator. According to the agreement reached, the threaded connection for the attachment of the canister of the protective mask must allow physical interchangability between the mask and canister, and the threaded connection must provide an airtight joint between the canister and the mask. Also the removal and replacement of the canister should not require tools of any kind.

Thus, while new canisters of a standard size and new masks which are now being made may conform to the terms of such an agreement, many "old" masks and canisters are still in use. Thus, a means of converting the canister mount of such old masks to receive canisters having a different sized and threaded connector (e.g. that proposed in the NATO standardization program) would be very desirable. Additionally, it would be desirable if a means could be provided which would adapt "new" masks manufactured according to such NATO standards to receive, alternatively, canisters having bolt connectors sized and threaded differently from such standard bolt size and thread, for example canisters of a different size and thread form which might be still readily available.

One proposal along these lines, to provide interchangability of connectors and masks while the change to the standard is taking place, has been to develop an adapter, one side of which has a bolt connector and a thread form to be threaded into one size of canister mount (e.g. that of old masks), and the other side of which has a threaded socket of a size and form to receive the bolt connector of canisters conforming to the new standard. Such adapter however has presented several practical problems which reduce its practicality. Because of its nature, it results in a canister being secured to the mask at a greater distance from the mask than one which is secured to the original canister mount of the mask, the canister thereby being more exposed as an obstruction and creating greater "assymetric loading" and consequently increasing the risk of breaking the peripheral face seal which must exist when the mask is worn, if such a mask is to effectively shield the face of the wearer against noxious or lethal gases. Also, when the wearer changes canisters, if such an adapter is used, the adapter must be normally held in place to prevent it becoming unscrewed while the old canister is being removed. Such a procedure is an awkward one for a person to carry out in the field and indeed, should the adapter become loose or removed while the canister changing is taking place, obvious dangers to the wearer, who must hold his breath during such operation, exist. This operation in some conditions (e.g. wartime conditions in the presence of certain types of gases) must be carried out with the wearer having gloves on, further complicating the operation. Additionally, such an adapter is a relatively small article and subject to loss by an individual carrying it.

It is an object of the present invention to provide a "universal" canister mount for a protective mask or the like which will receive at different times canisters having different sized and threaded bolt connectors. It is a further object of the present invention to provide such a canister mount which will remove the need for a separate adapter to achieve such end.

SUMMARY OF THE INVENTION

According to the present invention there is provided a multiple canister mount for protective masks or the like which will receive canisters having different sized and threaded bolt connectors. The device comprises a base and a pair of spaced annular rims secured and upwardly projecting from the base. The inner wall of each rim is threaded with threads of appropriate form, and is of a diameter, so as to receive a canisters bolt connector of particular size and having a particular thread form. The device also comprises a centrally disposed valve opening and valve seat secured to the base.

The canister mount according to the present invention provides a simple but effective means to secure canisters which may have bolt connectors of different size and thread form, at different times, to the same protective mask. It may also be used for collective protection systems such as filter blowers for air crew and air filtration systems for ships, where the mount is further provided with appropriate securing means to secure it, in airtight fashion, to the air inlet for such systems. The canister mount according to the present invention may be designed to accept both "old" and "new" canister bolt connectors, and eliminates many of the problems inherent with an adapter for such purposes such as loss, problems on changing canisters and assymetric loading of the mask.

BRIEF DESCRIPTION OF THE DRAWINGS

Other objects and advantages of the invention will become apparent upon reading the following detailed description and upon referring to the drawings in which.

Figure 1:
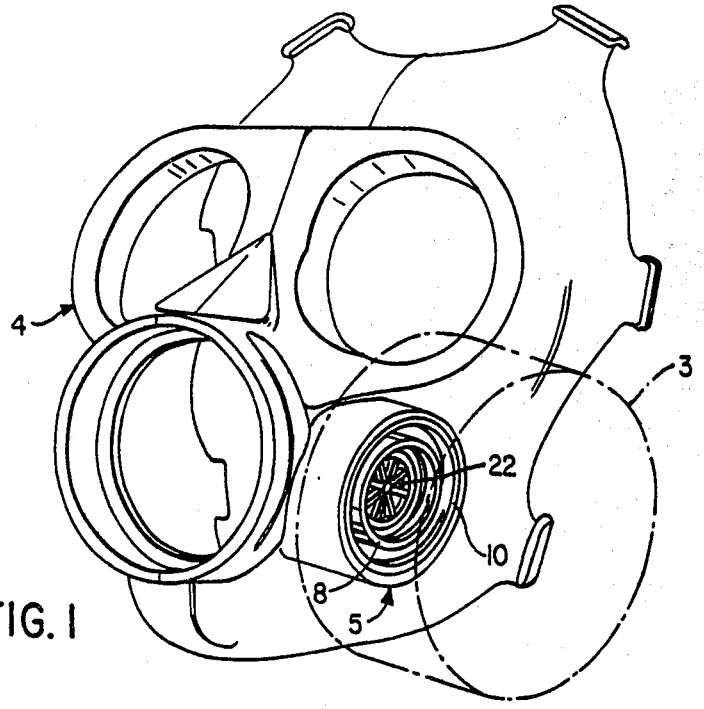
FIG. 1 is a perspective view of a protective mask to which a canister mount according to the present invention has been fitted.

While the invention will be described in connection with an example embodiment, it will be understood that it is not intended to limit the invention to such embodiments. On the contrary, it is intended to cover all alternatives, modifications and equivalents as may be included within the spirit and scope of the invention as defined by the appended claims.

DETAILED DESCRIPTION OF THE INVENTION

In the following description, similar features have been given similar reference numerals.

Turning to FIG. 1, there is shown a canister mount 2 for a standard charcoal filled canister 3 (shown in phantom) for a standard type of light type respirator mask used extensively by civilian and military organizations throughout the world. Canister mount 2 is appropriately secured, in airtight fashion, within air inlet opening 5 in the mask. (Other openings in the mask, not identified by reference numerals, are obviously intended respectively as openings to receive glass or other transparent viewing means, and for receiving an outlet valve and speech unit). When protective mask 4 is operatively in place on the face of a wearer, it is intended that an airtight seal is provided about its periphery between the mask and the wearer's skin, and that airtight seals are also formed in the openings for the viewing means and outlet valve and speech unit and the air inlet opening so that the only air which may be drawn into the mask by the breathing of the wearer is air which has been drawn through canister 3 and thereby subjected to the filtering effect of the charcoal within the canister.

Figure 2:
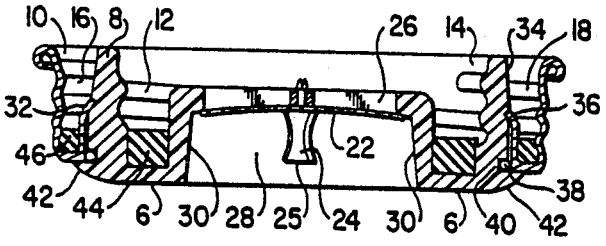
FIG. 2 is a side cross-sectional view along a diameter line of the canister mount of FIG. 1.

As can be seen in FIGS. 1 and 2, canister mount 2 according to the present invention comprises a base 6 to which are rigidly secured spaced inner annular rim 8 and outer annular rim 10. Since the canister mount of FIGS. 1 and 2 is intended primarily for use in gas masks or respirators as shown in FIG. 1, made of rubber or other appropriate flexible material, it is important that the outer circumference of the canister mount fit securely and flushly within air inlet opening 5. It has been found that making outer rim 10 of pressed metal facilitates the construction of the canister mount for this particular application of replacing the "old" canister mount and enables the construction of the canister mount to the desired shape and outer dimensions to relatively small tolerances.

Threads 12 are formed on the inner wall 14 of inner rim 8, and threads 16 are formed on the inner wall 18 of outer rim 10, the diametric distance between opposite inner walls of each of rims 8 and 10, and the form of threads 12 and 16 being such that a different sized bolt connector may be received by each of rims 8 and 10. The thread form of threads 12 and 16, and that of the canister bolt connectors may of course be the same or different, depending upon the application for which the canister mount 2 is designed.

An appropriate valve 22, being in the embodiment illustrated of a flexible flapper valve construction, is secured by valve securing means 24 to the lower, interior side of valve seat 26. The function of valve 22 is of course to prevent internal air from entering the canister of the protective mask through opening 28, across which valve 22 is seated, and directing the internal air through the outlet valve of the mask, when the canister of the protective mask 4 is being changed. Valve seat 26 is secured to base 6 by means of upstanding walls 30 which ensure that valve 22 is positioned above the lower end of the base so that the valve may operate free of constraint from internal parts of the face mask which might otherwise obstruct its operation. The interior, lower end 25 of valve securing means 24 also assists in this regard by bearing against any such internal parts of the mask which otherwise might interfere with the operation of valve 22.

In the embodiment of FIGS. 1 and 2, outer rim 10 is secured to the rest of the mount by flange 32, the end of which flange is inwardly biased against outer wall 34 of inner rim 8. The free end of flange 32 clips into notch 36 which circumscribes outer wall 34. A sealing means 38 comprising an O-ring is seated between flange 32 and outer wall 34 in notch 40, to prevent leakage of external air directly into the interior of a face mask in operation, between flange 32 and outer wall 34. Base 6 is provided with an extended portion 42 which metal rim 10 sits, when in position, for additional security and rigidity of the device. Additionally, to further guard against leakage of external, unpurified air directly into the interior of face mask 4 washers 44 and 46 are fitted to tightly circumscribe inner wall 14 of inner rim 8 and inner wall 18 of outer rim 10 respectively. These washers bear against the corresponding lower free end of a canister bolt connector which is fitted to either the inner rim 8 or outer rim 10 to effectively seal off leakage of air between the outer surface of that bolt connector and the inner wall of the corresponding rim.

Figure 3:
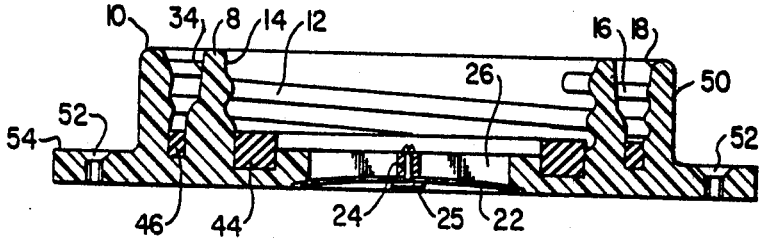
FIG. 3 is a side cross-sectional view along a diameter line of another embodiment of canister mount according to the present invention appropriate for use in collective protection systems.

In FIG. 3 there is shown an embodiment of canister mount 2 according to the present invention which is adapted for use with portable filtration systems such as filter blowers for air crew or collective protection systems such as filtration systems for ships. Such a mount for portable filtration units, and collective protection systems may not require an outer diameter of such precise size as is the case for mounts used for protective masks which must fit in an air inlet opening 5 (FIG. 1) of a particular size. As well, for such applications valve 22 generally need not be positioned above the lower end of base 6, as there is usually little to obstruct the operation of valve 22 immediately below the base of the mount, bolted over the air inlet opening in such applications. Valve securing means 22 can have a flat head, as shown, in FIG. 3, instead of stem as in FIG. 2.

As a result of these factors, outer rim 50 may be made of any appropriate material such as plastic, and may be integral with inner rim 8. Alternatively the inner rim 8 with appropriate threads, and base 6 may be moulded and welded by ultrasonic techniques to the outer rim 10, all of the parts being made of appropriate plastic material. There will be noted in FIG. 3 as well that valve seat 26 is positioned more or less in line with base 6, and is not upwardly raised with respect thereto as in the embodiment of FIGS. 1 and 2. A means for securing the canister mount 2 of FIG. 3, being screw holes 52, is provided in a flange 54 secured to base 6.

It will be understood from the foregoing description that the canister mount according to the present invention may be constructed to accept canister bolt connectors of different size and thread form, without the use of a separate adapter, thereby eliminating the risk of losing such adapter, not increasing assymetric loading where the mount is used with a mask, and eliminating potential problems and dangers when an adapter is removed with the canister. A practical advantage of the present invention is that the device may be made from materials such as valving, valve seating and external rims which are already available or easily adaptable from elements of existing canister mounts.

Thus it is apparent that there has been provided in accordance with the invention a multiple function canister mount that fully satisfies the objects, aims and advantages set forth above. While the invention has been described in conjunction with specific embodiments thereof, it is evident that many alternatives, modifications and variations will be apparent to those skilled in the art in light of the foregoing description. Accordingly, it is intended to embrace all such alternatives, modifications and variations as fall within the spirit and broad scope of the appended claims.

The embodiments of the invention in which an exclusive property or privilege is claimed are defined as follows:

1. A multiple canister mount, for receiving at different times different sized bolt connectors of canisters, comprising:

a base;

a pair of spaced inner and outer annular rims rigidly secured to and upwardly projecting from the base and each having inner and outer walls, the inner wall of each rim being threaded with threads of appropriate form, and being of a diameter so as to receive a canister bolt connector of particular size and particular thread form, the outer rim being formed of metal and the base and inner rim of integral plastic construction, the outer rim having a base, the base of said outer rim having an annular flange which extends upwardly and inwardly from the base of said outer rim, said outer rim being clipped securely to the inner rim and the base of said mount by means of said annular flange, the annular flange inwardly bearing against the outer wall of the inner rim;

sealing means provided between the annular flange and the outer wall of the inner rim to prevent passage of air therebetween; and a centrally disposed valve opening in the base of said mount and a valve seat secured to the base of said mount around said valve opening.

2. A canister mount according to claim 1 including a flapper valve for the valve opening and valve securing means, whereby said flapper valve is secured by said securing means to the valve seat.

3. A canister mount according to claim 1 including a circular notch defined in and extending about the outer wall of said inner rim, whereby said annular flange fits into said circular notch when said outer rim is clipped to said inner rim.

4. A canister mount according to claim 1 including a groove defined in and extending about the outer wall of said inner rim, said sealing means comprising an O-ring, said O-ring circumscribing the outer wall of the inner rim and seated partially in said groove thereabout.

5. A canister mount according to claim 1 wherein the valve seat is raised with respect to the base of said mount, whereby said valve seat is positioned above said base over said valve opening.

6. A device according to claim 1 further provided with means for securing said mount in airtight fashion over an air inlet opening of a portable filtration system.

* * * * *